US006053225A

United States Patent [19]

Yanai et al.

[11] Patent Number: 6,053,225

[45] Date of Patent: Apr. 25, 2000

[54] WOOD MOLDING PROCESS

[75] Inventors: Yuichi Yanai; Takeo Ishikawa; Kazuhiko Arakawa, all of Okazaki, Japan

[73] Assignee: Nisshinbo Industries, Inc., Tokyo, Japan

[21] Appl. No.: 09/245,852

[22] Filed: Feb. 8, 1999

[30] Foreign Application Priority Data

Feb. 10, 1998 [JP] Japan ..... 10-044597

[51] Int. Cl.[7] ..... B27M 1/02

[52] U.S. Cl. ..... 144/361; 144/364; 144/271; 427/370

[58] Field of Search ..... 144/361, 364, 144/380, 381, 271; 427/154, 370; 428/511

[56] References Cited

U.S. PATENT DOCUMENTS

| | | | |
|---|---|---|---|
| 3,282,313 | 11/1966 | Schuerch | 144/327 |
| 3,646,687 | 3/1972 | Berzin et al. | 34/13.8 |
| 4,017,980 | 4/1977 | Kleinguenther | 34/13.4 |
| 4,325,420 | 4/1982 | Zeloof | 144/271 |
| 4,586,751 | 5/1986 | McGuire | 297/445 |
| 4,605,467 | 8/1986 | Bottger | 156/497 |
| 4,606,388 | 8/1986 | Favot | 144/361 |
| 4,649,065 | 3/1987 | Hein et al. | 427/370 |
| 5,343,913 | 9/1994 | Tanahashi et al. | 144/380 |
| 5,360,631 | 11/1994 | Strauss | 427/154 |
| 5,453,327 | 9/1995 | Strauss | 428/511 |

*Primary Examiner*—Joseph J. Hail, III
*Assistant Examiner*—Dermott J. Cooke
*Attorney, Agent, or Firm*—Birch, Stewart, Kolasch & Birch, LLP

[57] ABSTRACT

A wood molding process which comprises treating woods with liquid ammonia, removing said liquid ammonia by evaporation, softening woods with heating and molding them into a desired shape, and treating the molded woods with hot water or steam.

7 Claims, 2 Drawing Sheets

WOOD MOLDING PROCESS

BACKGROUND OF THE INVENTION

The present invention relates to a wood molding process and, more particularly, to a wood molding process which imparts a stable fixed shape to molded woods.

Wood molding is a common practice for production of furniture, toys, sporting goods, musical instruments, commodities, barrels, and crafts. Making a round timber into a square timber by compression molding is another common practice. These wood molding processes are accomplished in any of the following ways.

(1) Softening by microwave heating and subsequent molding, followed by several repetitions of slow cooling and rapid secondary heating with the molded configuration retained for relieving internal stress due to molding. For example, molding round timber of Japanese cedar into square timber involves steps of microwave heating a round timber at about 120° C. for about 30 minutes, gradually compressing the softened round timber into a square timber by means of a press, and repeating several times slow cooling and rapid secondary heating while retaining the molded configuration. Without the slow cooling and rapid secondary heating, the molded square timber would restore its original shape after repeated moisture absorption and drying.

(2) Softening by microwave heating and subsequent molding, followed by high-pressure steam treatment with the molded configuration retained.

(3) Softening by impregnation with liquid ammonia and subsequent molding, followed by removal of ammonia. (U.S. Pat. No. 3,282,313)

(4) Heating under pressure in an ammonia gas atmosphere, thereby giving molded timber with a uniform high packing density, followed by removal of ammonia gas. (U.S. Pat. No. 3,646,687)

The foregoing processes have their respective disadvantages as follows.

(1) Difficulties in process control and productivity on account of the necessity of repeating post-molding cooling and heating while keeping the molded configuration.

(2) Necessity for high-temperature heat treatment (e.g., at 200° C. for 1 minute or at 180° C. for 8 minutes) with high-pressure steam after molding. With heat treatment at 140° C. or below, the molded wood returns to its original shape when exposed to hot water. The resulting molded wood decreases in strength and hence needs impregnation with an adhesive such as isocyanate resin.

(3) Pollution of the working and surrounding environments with ammonia which vaporizes at the time of molding. Liquid ammonia impregnated into wood converts wood cellulose into plasticized ammonia cellulose and stays in wood until molding. Instability in the molded shape because of reversion of cellulose III resulting from treatment with liquid ammonia to more stable cellulose I on prolonged heating in the presence of water.

(4) Poor productivity. Molding wood in hot ammonia gas at 120° C. under a pressure of 0.1–10 kg/cm$^2$ takes a long time, for example, 50–200 hours for birch.

SUMMARY OF THE INVENTION

It is an object of the present invention to provide a new wood molding process which needs no chemicals such as adhesive, works at a lower temperature and in a shorter time than conventional ones, produces molded wood with a stable fixed shape without appreciable decrease in strength, and causes no environmental pollution.

As the results of extensive studies carried out to address the above-mentioned problems, the present inventors found that it is possible to obtain molded woods with an extremely stable form by the process which comprises treating woods with liquid ammonia, removing said liquid ammonia by evaporation, thereby converting wood cellulose into cellulose III, heating and softening woods and molding them into a desired shape, and treating the molded woods with hot water or steam while keeping their shape, thereby converting cellulose III into stable cellulose I. The heating and softening step may be accomplished in hot water or steam. This finding led to the present invention.

Accordingly, the present invention provides a wood molding process which comprises treating woods with liquid ammonia, removing said liquid ammonia by evaporation, softening woods with heating and molding them into a desired shape, and treating the molded woods with hot water or steam.

DESCRIPTION OF THE PREFERRED EMBODIMENTS

Figure 1:
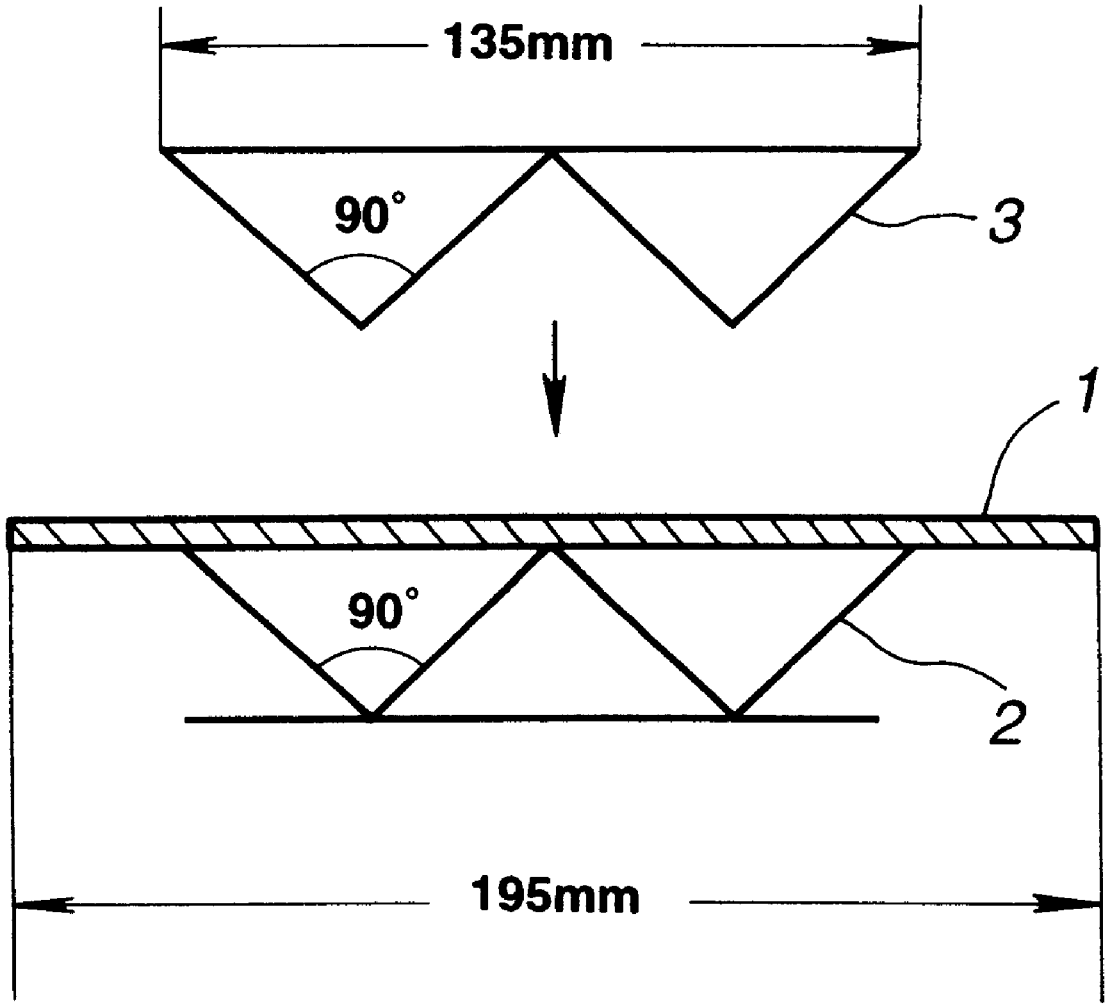
FIG. 1 is a diagram illustrating how to mold woods in Example.

The wood molding process of the present invention can be applied to any common trees including softwood trees such as Japanese red pine, Jezo spruce, Saghalin fir, Japanese cedar, Japanese fir, Japanese hemlock, Hondo spruce, Japanese larch, hemlock, spruce, and pine and hardwood trees such as Japanese beech, birch, oak, Japanese alder, eucalyptus, mangroves, acacia, and rubber tree. These woods are generally composed of cellulose which is a crystalline high polymer, hemicellulose which is a non-crystalline high polymer, and lignin which is an amorphous crosslinked high polymer, although their specific composition varies from one wood to another.

Woods to be molded may be in the form of round timber as cut down, square timber with peripheries sawed off, or boards.

The process of the present invention starts with treatment of woods such as round timbers with liquid ammonia. This treatment may be accomplished by dipping woods in liquid ammonia at −33° C. or below. Dipping time depends on the kind and shape of woods so long as liquid ammonia is fully infiltrated into wood. Preferably, dipping may last for 10 to 30 seconds after the uniform infiltration of ammonia into wood.

Liquid ammonia may be replaced by lower alkylamine such as methylamine and ethylamine.

Then, treated woods are completely freed of ammonia by heating with hot air at 40 to 90° C. for 10 minutes or longer.

Subsequently, the woods are molded and have their shape fixed by either of the following two methods.

(1) Softening woods by microwave heating or high-frequency heating and molding them into a desired shape (the first step), and treating the molded woods with hot water or steam while keeping their shape (the second step), thereby fixing their shape. The first step may or may not be followed by temporary cooling.

(2) Softening woods by heating in hot water or steam and molding them into a desired shape, and treating the molded woods with hot water or steam while keeping their shape, thereby fixing their shape.

The first method should preferably be used for woods whose equilibrium moisture content is about 12%. Woods with an excessive moisture content are liable to partial breaking of tissues by internal pressure of water.

The heating condition is suitably selected so that woods soften for molding. Preferably, the heating condition is as follows:

at from 98° C. to less than 120° C. for one hour or longer, at from 120° C. to less than 140° C. for 30 minutes or longer, and at from 140° C. to 200° C. for 15 minutes or longer.

Although the maximum heating time is not limited, it may preferably be 3 hours.

The molding of woods is accomplished by any known method such as compression, curving, bending, and die pressing.

In the second method, woods are heated, softened, and molded in hot water or steam with the condition described later. After the woods are molded into a desired shape, the hot water or steam treatment is still lasted.

After molding as mentioned above, the molded woods are treated with hot water or steam, with their shape kept unchanged, so that their shape is fixed.

This treatment is carried out at 60 to 200° C. for 10 minutes to 48 hours, preferably at 98 to 140° C. for 20 minutes to 6 hours, although the condition is selected depending on kinds and shape of woods. Typically, the treatment is carried out at 100° C. for about 6 hours in the case of hot water and at 130° C. for about 30 minutes in the case of steam.

Treatment with hot water or steam is followed by drying to remove excess water by evaporation.

The molded wood obtained by the process of the present invention has its shape fixed permanently. A conceivable reason for this is given below.

Wood in its natural state contains natural cellulose which is identified as cellulose I by its crystalline structure. Upon treatment with liquid ammonia, cellulose I takes on the crystalline structure of cellulose III. Liquid ammonia infiltrates into the crystalline region as well as the amorphous region of cellulose, thereby breaking hydrogen bonds and swelling cellulose. As ammonia is evaporated by heating, cellulose has new hydrogen bonds formed therein, with the result that cellulose III grows in the crystalline region and the crystals are fixed in the swollen state. The molded wood having cellulose III is heated with hot water or steam so that lignin is softened. In this treatment, cellulose III reverts to stable cellulose I, with the shape retained in the swollen state. This conversion of crystalline structure is responsible for the fixing of shape.

EXAMPLE

The invention will be described in more detail with reference to the following examples, which are not intended to restrict the scope of the invention.

Example 1

A thin board of Japanese cedar, measuring 100 mm wide, 195 mm long, and 1 mm thick, was immersed in liquid ammonia for 24 hours. It was taken out from liquid ammonia and allowed to stand in the air at 40° C. for 2 hours so as to evaporate and remove ammonia and to dry the thin board.

Figure 2:
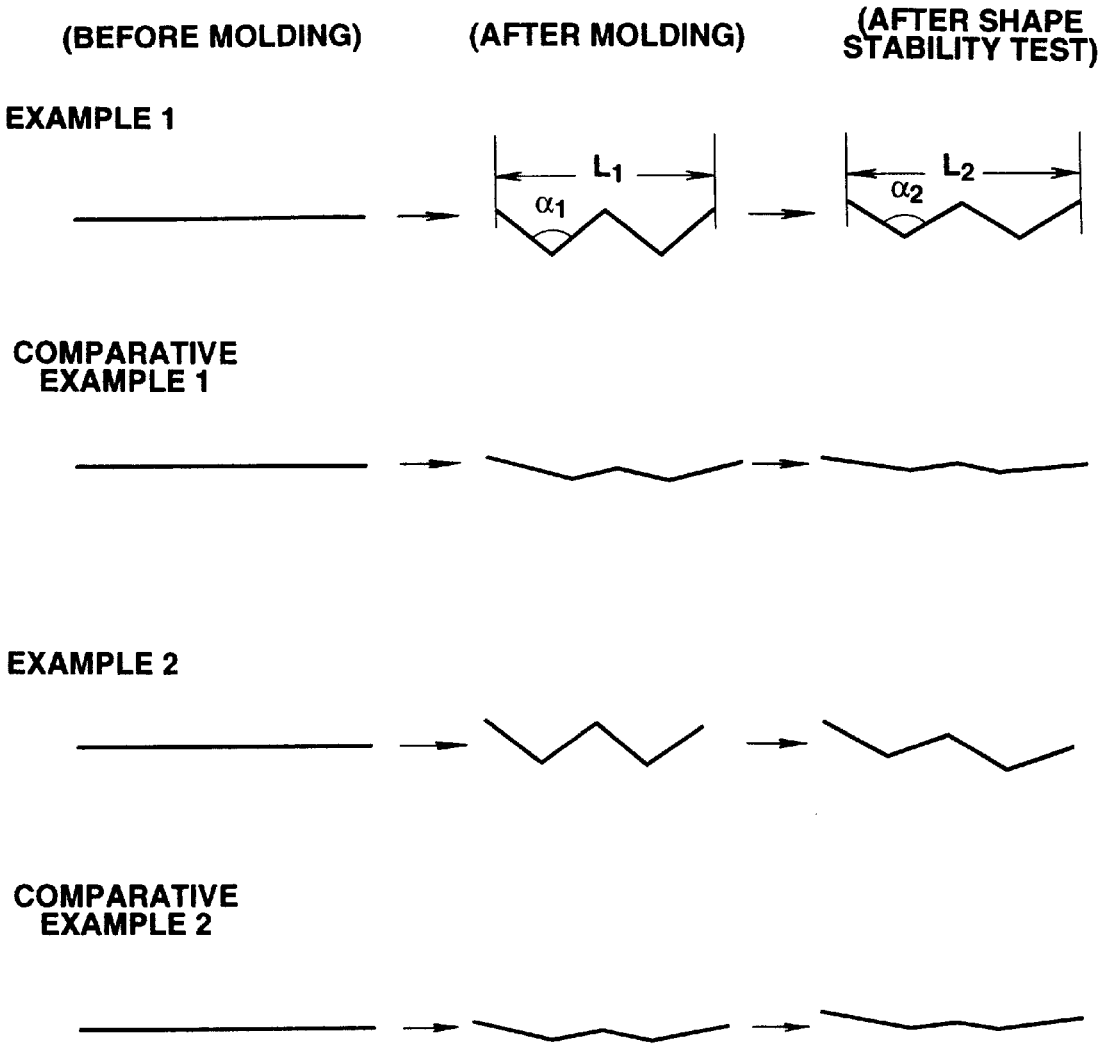
FIG. 2 is a diagram illustrating how woods change in shape after molding and shape stability test.

The thin board 1 was placed on a molding jig 2 with a cross section of W figure consisting of steel angle bars welded together, as shown in FIG. 1. On the thin board 1 was placed a second molding jig 3 weighing 1.2 kg similar to the first one 2, such that the ridges of the jig are perpendicular to the length of the thin board, as shown in FIG. 1. The assembly was immersed in boiling water (100° C.) for 6 hours. The molded thin board was air-dried at 40° C. for 24 hours. After molding, the distance ($L_1$) along the length between two ends was measured to determine the degree of deformation due to molding. The molded thin board was immersed in boiling water (100° C.) for 30 minutes and then air-dried at 40° C. for 24 hours. After drying, the distance ($L_2$) along the length between two ends was measured to determine the shape stability. The results of measurements are shown in Table 1. The change in shape after molding and heating is shown in FIG. 2.

Comparative Example 1

The same procedure as in Example 1 was repeated except that treatment with liquid ammonia was omitted. The results of measurements are shown in Table 1. The change in shape after molding and heating is shown in FIG. 2.

TABLE 1

| | $L_1$ (mm) | $L_2$ (mm) |
|---|---|---|
| Example 1 | 150 | 165 |
| Comparative Example 1 | 190 | 193 |

Example 2

The same procedure as in Example 1 was repeated except that molding by treatment with boiling water at 100° C. for 6 hours was replaced by molding by treatment with steam at 130° C. for 30 minutes. The results of measurements are shown in Table 2. The change in shape after molding and heating is shown in FIG. 2.

Comparative Example 2

The same procedure as in Example 2 was repeated except that treatment with liquid ammonia was omitted. The results of measurements are shown in Table 2. The change in shape after molding and heating is shown in FIG. 2.

TABLE 2

| | $L_1$ (mm) | $L_2$ (mm) |
|---|---|---|
| Example 2 | 155 | 175 |
| Comparative Example 2 | 191 | 194 |

The above-mentioned examples show that the thin boards treated with liquid ammonia conformed well to the W-shaped jig with the angle $\alpha_1$ being 90–100° and retained their shape after boiling with the angle $\alpha_2$ being 120–130°, whereas the thin boards without ammonia treatment did not conform to the jig and restored their original shape almost completely after boiling. It is apparent from these results that treatment with liquid ammonia facilitates wood molding by heating with hot water or steam and contributes to the stability of the molded wood.

The wood molding process of the present invention produces marked effects as follows.

(1) It yields molded woods which retain their shape even after heating for a long time in the presence of water, because the molded woods have their cellulose crystalline structure converted from cellulose III to more stable cellulose I.

(2) It yields molded woods which experience very little dimensional change due to moisture absorption after molding, because their shape is fixed in the swollen state in the case of treatment with hot water.

(3) It has no adverse effect on the working environment because treatment with liquid ammonia, removal of ammonia by heating, and treatment with hot water or steam can be all carried out in a closed system.

(4) It permits liquid ammonia to be recovered without air pollution problem.

What is claimed is:

1. A wood molding process which comprises the following steps in the following order:

treating woods with liquid ammonia by dipping said woods into liquid ammonia at up to −33 degrees Celsius for a time sufficient to allow uniform infiltration of ammonia into wood;

removing said liquid ammonia by heat-induced evaporation thereby wonverting wood cellulose I into cellulose III;

softening woods with heating and molding them into a desired shape; and treating the molded woods with hot water or steam thereby converting cellulose III into cellulose I.

2. A wood molding process which comprises the following steps in the following order:

treating woods with liquid ammonia by dipping said woods into liquid ammonia at up to −33 degrees Celsius for a time sufficient to allow uniform infiltration of ammonia into wood;

removing the liquid ammonia by heat-induced evaporation thereby converting wood cellulose I into cellulose III;

softening the woods by heating in hot water or steam and molding the woods into a desired shape:

and treating the molded woods with hot water or steam thereby converting cellulose iii into cellulose I.

3. The process of claim 1 wherein the softening step comprises heating by microwave or high-frequency heating.

4. The process of claim 1 or 2 wherein the heating is conducted at from 98° C. to less than 120° C. for one hour or longer, at from 120° C. to less than 140° C. for 30 minutes or longer, and from 140° C. to 200° C. for 15 minutes or longer.

5. The process of claim 1 or 2 wherein the treatment with hot water or steam after molding is carried out at 60 to 200° C. for 10 minutes to 48 hours.

6. The process of claim 1 or 2 wherein the treating woods with liquid ammonia step comprises dipping in liquid ammonia at −33° C. or below for 10 to 30 seconds after uniform infiltration of ammonia into wood and freeing the wood from ammonia by heating with hot air at 40 to 90° C. for 10 minutes or longer.

7. The process of claim 3 wherein the woods have equilibrium moisture content of 12%.

* * * * *